United States Patent [19]

Dannoura

[11] Patent Number: 4,871,010

[45] **Date of Patent: * Oct. 3, 1989**

[54] VERTICAL INJECTION APPARATUS FOR DIE CASTING MACHINE

[75] Inventor: Sadayuki Dannoura, Yamaguchi, Japan

[73] Assignee: Ube Industries, Ltd., Ube, Japan

[ * ] Notice: The portion of the term of this patent subsequent to Oct. 25, 2005 has been disclaimed.

[21] Appl. No.: 219,737

[22] Filed: Jul. 15, 1988

Related U.S. Application Data

[60] Continuation of Ser. No. 81,345, Aug. 4, 1987, Pat. No. 4,779,664, which is a division of Ser. No. 830,971, Feb. 19, 1986, abandoned.

[30] Foreign Application Priority Data

Feb. 20, 1985 [JP] Japan ..... 60-30539
Feb. 20, 1985 [JP] Japan ..... 60-21996
Apr. 5, 1985 [JP] Japan ..... 60-70790

[51] Int. Cl.[4] ..... B22D 17/14
[52] U.S. Cl. ..... 164/253; 164/312
[58] Field of Search ..... 164/4.1, 457, 154, 253, 164/254, 255, 256, 257, 305, 312, 410, 61, 62, 63, 65, 113; 425/542, 546, 812

[56] References Cited

U.S. PATENT DOCUMENTS 3,209,416 10/1965 Morton ..... 164/312
4,088,178 5/1978 Ueno et al. ..... 164/312
4,726,415 2/1988 Ueno et al. ..... 164/332

FOREIGN PATENT DOCUMENTS 57-72766 5/1982 Japan ..... 164/63

*Primary Examiner*—Richard K. Seidel
*Attorney, Agent, or Firm*—Blakely, Sokoloff, Taylor & Zafman

[57] ABSTRACT

A vertical injection apparatus for a die casting machine is disclosed. The setting is made such that a timing for vacuum evacuation applied to a portion into which air enters is suitably earlier than that for vacuum evacuation applied to a die cavity. Thus, this allows a solidification layer tightly formed on the end surface of a plunger tip to prevent air from entering into the die cavity, making it possible to desirably carry out injection and to remarkably improve quality of casting products. By improving the structure for holding a vacuum evacuating tube, this apparatus can facilitate repairing word required when the evacuating tube is clogged with hot molten metal.

9 Claims, 7 Drawing Sheets

VERTICAL INJECTION APPARATUS FOR DIE CASTING MACHINE

This is a continuation of application Ser. No. 081,345, now U.S. Pat. No. 4,779,664, filed Aug. 4, 1987 which is a division of application Ser. No. 830,971 filed Feb. 19, 1986, now abandoned.

BACKGROUND OF THE INVENTION

The present invention relates to a vertical injection apparatus for a die casting machine wherein an injection sleeve is inserted into an injection bore of a die and hot molten metal poured in the injection sleeve is injected into a cavity within the die. Specifically, the present invention is concerned with a die casting apparatus wherein during casting, a portion into which air intrudes is evacuated prior to vacuum evacuation of the cavity of the die.

Casting methods with die casting machines have been widely popularized in the art as typical methods of manufacturing a large number of precision casting products. The casting of this kind is, implemented such that a metal mold cavity is filled with molten metal at high speeds and under high pressures. Accordingly, there is a possibility that gas within the cavity is not sufficiently vented, with the result that such a gas is mixed with molten metal to remain within the product in the form of gas pockets. For this reason, in many applications, prior art casting is not suitable for obtaining products particularly required of high quality free from gas pockets.

To solve such an inconvenience, as disclosed in Japanese Utility Model Laid-open Specification No. 57-13873 and so on, the applicant of this invention has developed and proposed a gas vent device for metal die capable of venting or degassing die cavity during casting to eliminate gas involvement, thus making it possible to produce high quality die casting products.

This gas vent device has a gas vent valve within a gas exhaust path for connecting the die cavity to the outside, whereby hot molten metal is injected into the cavity when this valve is opened and, upon complete of exhaustion of the gas of small mass within the die cavity the gas vent valve is closed by an inertial force of hot molten metal of large mass from the cavity entering the gas exhaust path, thus preventing the hot molten metal from flowing out. With this device, venting of gas within the die can be securely and easily performed.

Further, the applicant of this application has also developed a decompression or vacuum type die casting method and apparatus wherein the above-mentioned gas exhaust path is connected to a vacuum generating device, thereby positively evacuating gas within the die cavity. This pressure reduction type die casting method is to effect decompression by evacuating gas in excess of the amount of gas flowing from the outside of the die into the cavity through a gap, thus promoting degassing within the mold.

However, in the above-mentioned casting method there occurs gas flow from the outside to the inside via a gap between an injection sleeve and a plunger tip because of the difference between the amount of exhaust gas from the cavity and the amount of gas flowing into the cavity. Therefore, when the cavity is evacuated to vacuum, part of the hot molten metal within the injection sleeve is almost bubbled and randomly sucked up into the cavity before injection, thus producing a thin solidification layer along the internal surface of the cavity. Accordingly, once such a condition is produced, satisfactory injection products cannot be obtained. Further, even when injection is desired to be effected, moisture, mold release or lubricating agent etc. outside the cavity is sucked into the cavity, or hot molten metal within the injection sleeve is sucked into the cavity at a phase where the degree of vacuum is not sufficiently raised. As a result, impurity such as lubricating agent will be mixed into the product, thus degrading the quality of the product, or moisture comes in contact with the injected hot molten metal to turn into gas to thereby create gas pockets, thus failing to exhibit sufficient vacuum effect. In addition, because of the fact that hot molten metal is sucked before a pressure within the cavity reaches a sufficient degree of vacuum, there is a possibility that it involves gas thereinto, or admixing of hot molten metal previously injected and that injected subsequently is not sufficiently carried out, thus degrading the appearance of the product.

Further drawbacks of the above-mentioned conventional casting apparatus will be pointed out. When injection is carried out while the inside of the metal mold cavity being evacuated to vacuum from above, air is sucked thereinto via a contact portion of the injection sleeve. Accordingly, when a solidification layer produced at the top of the plunger tip at the initiation of the injection is crushed down at the time of injection, air admitted via the contact portion of the injection sleeve enters into the hot molten metal, with the result that air enters into the cavity of the die along with the hot molten metal. Such an inconvenience will be explained in an illustrated manner with reference to FIG. 18. Into an injection bore 4 of a die 3 having a cavity 1 and a constricted portion 2, a stationary sleeve 5 is fitted and an injection sleeve 7 into which hot molten metal 6 is supplied for injection is inserted. Into an inner hole of the injection sleeve 7, a plunger tip 8 is slidably fitted. At the time of intiation of the injection, a solidification layer 9 is produced due to the fact that the hot molten metal 6 is solidified on the end surface in contact with the hot molten metal of the plunger tip 8 and the internal surface of the injection sleeve 7 contiguous therewith. The solidification layer 9 is pushed up by the plunger rising for injection, and is compressed and crushed down between a plane 10 in front of the constricted portion 2 and the end surface of the plunger tip 8, with the result that it is left along with a biscuit of a solidified material of the hot molten material 6 within the stationary sleeve 5 without entering into the cavity 1. When taking out the product, the solidification layer 9 integral with the biscuit is separated from the constricted portion 2.

However, in the conventional casting apparatus, when gas within the cavity 1 is evacuated to vacuum, air is sucked from a gap between the injection bore 4 of the die 3 and the injection sleeve 7 inserted thereinto. Thus, air intrudes into a gap between the internal surface of the stationary sleeve 7 and the solidification layer 9. Further, the solidification layer 9 is compressed by the plunger tip 8 to come in contact with the plane 10. As a result, when the solidification layer 9 is partially broken in succession as indicated by reference numeral 9A in the figure, the admitted air enters into the hot molten metal via gaps between the broken solidification layer fragments 9A and enters into the cavity 1 via the molten metal and the constricted portion 2. Consequently, the air and the hot molten metal alternately pass through the constricted portion 2. As a result, the flow of the hot molten metal is disturbed, thus failing to provide high quality casting products.

In view of this, the applicant of this application has proposed a casting method and an apparatus therefor as described in Japanese Patent Laid-open Specification No. 59-144566 etc. wherein vacuum evacuation is implemented from the sliding surface of the plunger tip simultaneously with decompression within the die cavity. The configuration illustrated as an example of the apparatus is such that a groove is formed in the outer peripheral surface of the plunger tip slidable within the injection sleeve and the groove is connected to a vacuum generating device. In this example, for convenience of machining the groove and an air passage, there is employed a so called double-tip to divide the plunger tip in an axial direction whereby a groove is formed at its boundary portion or in the upper outer periphery of one segmental plunger tip, and an air passage is provided which axially penetrating through the other segmental plunger tip and the plunger rod.

However, the drawback with the above-mentioned conventional injection plunger device of the double-tip type is as follows. In the event that, when part of hot molten metal within the injection sleeve is sucked at the time of vacuum evacuation, an air passage is clogged with the hot molten metal, it is necessary to cut the plunger rod at the clogged portion to remove the clogged material or to exchange the faulty plunger rod with a new one, with the result that not only much time and labor for the repairing work is required, but also its cost is increased.

SUMMARY OF THE INVENTION

With the above in view, an object of the present invention is to provide a vertical injection apparatus for a die casting machine wherein a timing for vacuum evacuation applied to a portion into which air enters is made suitably earlier than that for vacuum evacuation applied to a die cavity, thus allowing a solidification layer tightly formed on the end surface of a plunger tip to prevent air from entering into the die cavity.

Another object of the present invention is to further promote the prevention of air flow into the dive cavity.

A further object of the present invention is to provide a vertical injection apparatus which can facilitate repairing work required when a vacuum evacuating tube used for evacuation of air within an injection sleeve is clogged with hot molten metal.

To achieve these objects, the present invention provides a vertical injection apparatus for a die casting machine comprising a die having a die cavity, an injection sleeve slidably fitted in an injection bore formed in the lower end portion of the die, a stationary sleeve fixedly mounted in the injection bore and engagable with the injection sleeve, and plunger means, slidable in the injection sleeve, for injecting a hot molten material poured in the injection sleeve into the die cavity, characterized in that there is provided means for evacuating, prior to initiation or in the course of the injection of the molten material, a portion into which air enters and the die cavity such that a timing for evacuation of the portion precedes a timing for evacuation of the die cavity by a predetermined amount. The portion includes a gap between the injection sleeve and plunger means. The plunger means has a plunger tip formed, in its outer peripheral surface, with an annular groove whereby the evacuation of the portion is effected through the annular groove.

The portion further includes a cavity formed in the die and air prevailing between the die and the injection sleeve can be evacuated via this cavity. In this instance, sealing member may be provided between the upper end surface of the injection sleeve and the lower end surface of the stationary sleeve.

The plunger means includes a plunger rod and adapter may detachably be mounted between the plunger tip and the plunger rod. In this instance, a cavity may be formed in the end portion of the adapter opposing the plunger tip, the cavity communicating with a gap between the plunger tip and the injection sleeve and being contiguous to a hole formed in the adapter, a notch may be formed in the plunger rod, the notch opening to the outer peripheral surface of the plunger rod, and a vacuum evacuating tube may be fitted in the notch, having one end connected to a vacuum evcuating device and the other end inserted in the hole in the adapter.

BRIEF DESCRIPTION OF THE DRAWINGS

The features and advantages of a casting apparatus according to the present invention will become more apparent from the following description taken in conjunction with the accompanying drawings in which.

DESCRIPTION OF THE PREFERRED EMBODIMENTS

Figure 1:
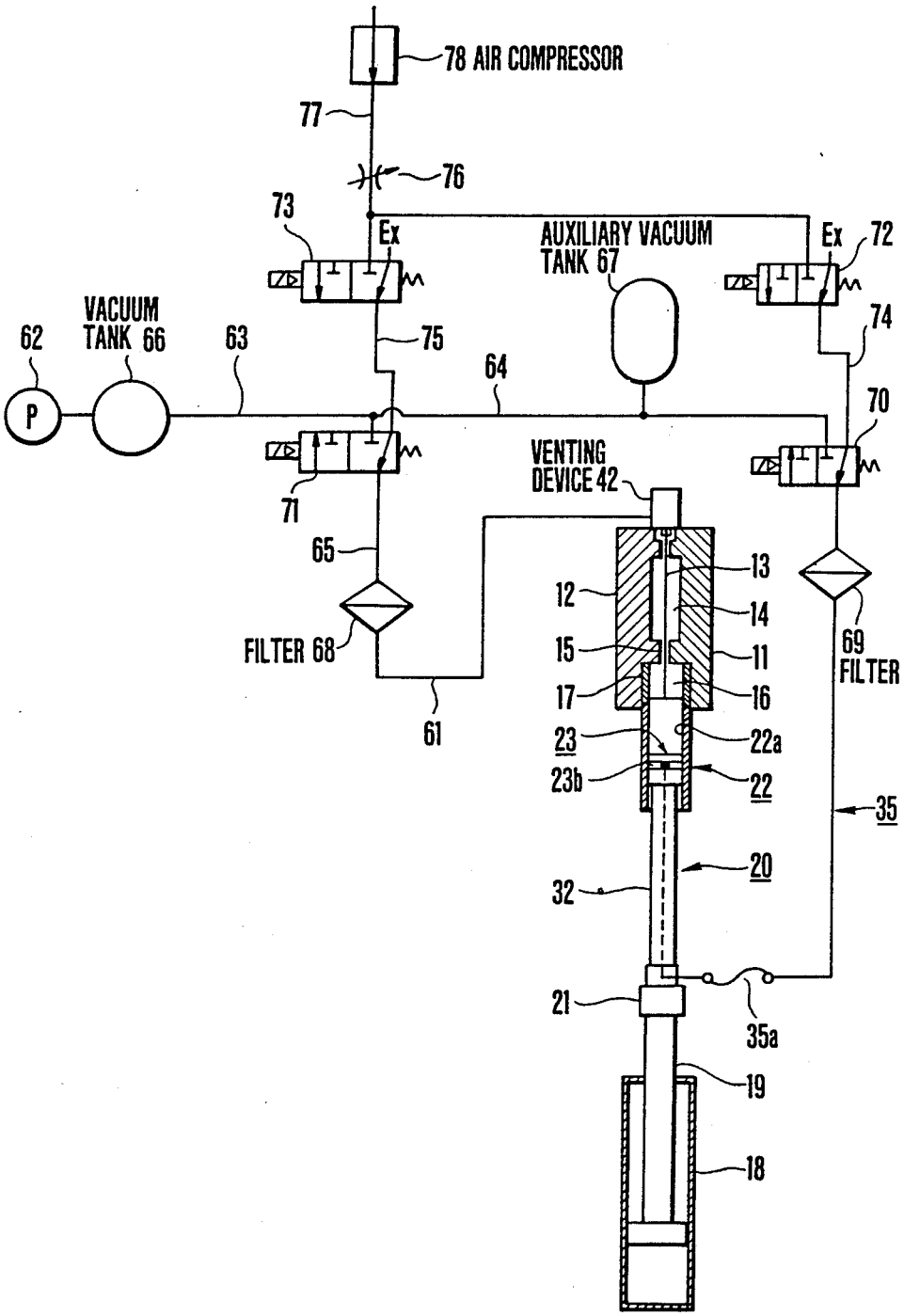
FIG. 1 is a diagrammatical view illustrating a first embodiment of a casting apparatus employed in the present invention and an air pressure pipe arrangement associated therewith.

Initially, a preferred first embodiment of a die casting apparatus according to the present invention will be described with reference to FIGS. 1 to 7.

A die casting apparatus of this embodiment comprises stationary and movable metal molds 11 and 12 of a die which are joined at a dividing surface 13 and clamped with each other. The thus jointed metal molds 11 and 12 define a cavity 14, a constricted portion 15 and a vertical hole portion 16 which are substantially symmetrical with the dividing surface 13. Into the vertical hole portion 16, a stationary sleeve 17 is snugly fitted. The die casting machine in this embodiment is of lateral clamping and vertical casting type and by horizontally moving the movable metal mold 12, the die is clamped or opened. The principal operation of this type is described in detail in the Japanese Patent Publication No. sho 58-55859 published on Dec. 12, 1983. An injection cylinder 18 is disposed directly below the metal molds 11 and 12. The injection cylinder 18 is provided with a piston rod 19 operable to advance or withdraw by oil pressure. To the operating end of the rod 19, a plunger 20 shown in detail in FIGS. 2 to 5 is coaxially joined by means of a coupling 21. An injection or casting sleeve 22 is formed so that its diameter is the same as that of the stationary sleeve 17. A cylinder (not shown) raises the injection sleeve 22 to cause it to engage the stationary cylinder 17 or lowers the injection sleeve 22 to cause it to disengage the stationary cylinder 17. Into an inner hole **22*a* of the injection sleeve 22, a plunger tip 23 provided at the head of the plunger 20 is slidably fitted. When pouring hot molten metal into the casting sleeve 22 the casting sleeve 22 is disengaged from the stationary sleeve 17 and the casting sleeve 22 with the plunger tip 23 fitted thereinto is tilted along with the injection cylinder 18 by means of a tilting cylinder (not shown). After completion of the pouring of the hot molten metal, the injection cylinder 18 is set up vertically, the casting sleeve 22 is engaged with of oil pressure, thereby allowing the plunger tip 23 to inject the hot molten metal into the cavity 14**.

Figure 2:
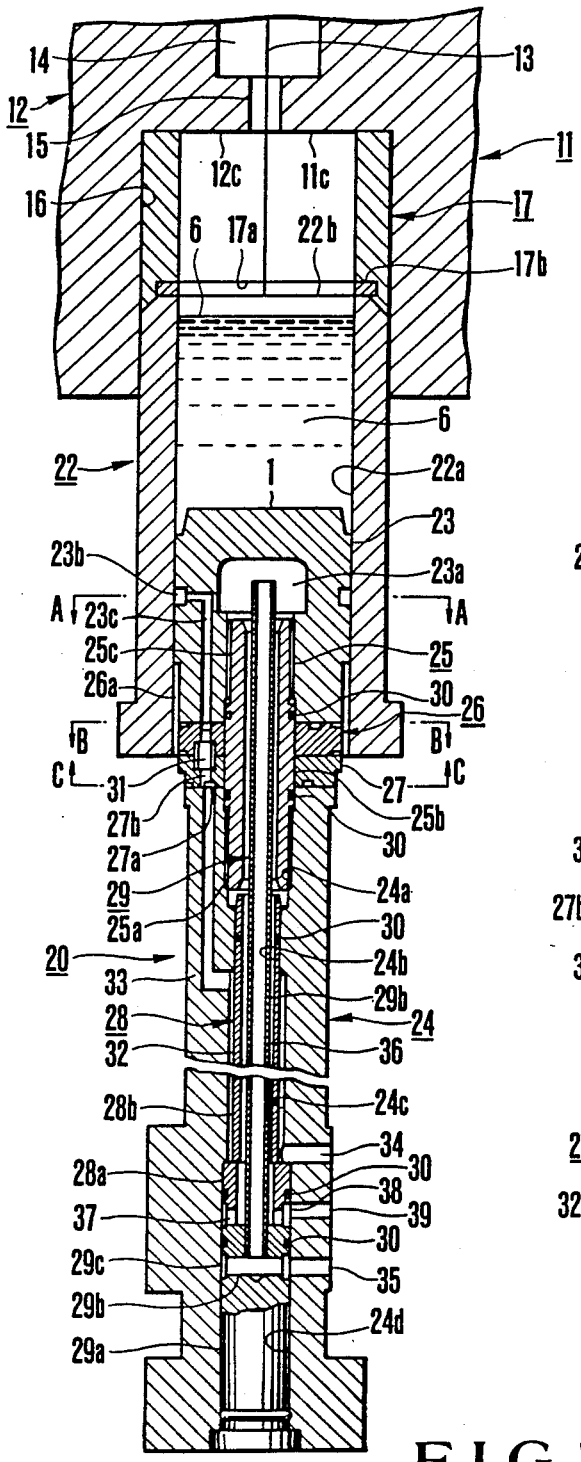
FIG. 2 is an enlarged longitudinal sectional view illustrating an injection sleeve and a plunger provided in the casting apparatus shown in FIG. 1.
Figure 3:
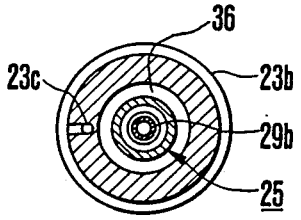
FIG. 3 is a cross sectional view taken along the line A—A of FIG. 2.
Figure 4:
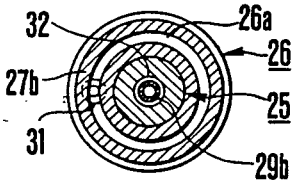
FIG. 4 is a cross sectional view taken along the line B—B of FIG. 2.
Figure 5:
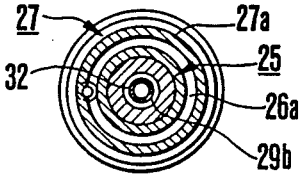
FIG. 5 is a cross sectional view taken along the line C—C of FIG. 2.

Details of the plunger tip 23 will be now described. A plunger rod 24 joined to the piston rod 19 by means of the coupling 21 is formed with a bore comprising a threaded hole **24*a*, an evacuation tube supporting hole 24*b*, an air passage hole 24*c*, and a bottom hole 24*d* which have different diameters and are in succession from above in the order mentioned. Into the uppermost threaded hole 24*a*, a lower threaded portion 25*a* of a screw tube 25 is fully screwed until it abuts against a shoulder. On an intermediate non-threaded portion 25*b* of the screw tube 25, a pair of upper and lower adapters 26 and 27, are loosely fitted. These adapters are clamped and fixed by the plunger tip 23 meshed with an upper threaded portion 25*c* of the screw tube 25 and the plunger rod 24. An evacuation tube 28 comprises a retaining tube 28*a* and a tube 28*b* fused thereto. The evacuation tube 28 is inserted through the bottom hole 24*d* so that the retaining tube 28*a* is sungly fitted in the upper portion of the bottom hole 24 and the tube 28*b* extends through the air passage hole 24*c*, terminating in an upper portion which is sungly fitted in the evacuation tube supporting hole 24*b*. A water cooling tube 29 comprises a retaining shaft 29*a* and a tube 29*b* fused thereto. The retaining shaft 29*a* of water cooling tube 29 sungly fitted in the bottom hole 24*d* supports the retaining tube 28*a* from below. The tube 29*b* extends through the retaining tube 28*a*, the tube 23*b* and the screw tube 25, terminating in an upper end which lies in a cavity 23*a* formed in the plunger tip 23. A number of O rings serving as sealing members are provided at predetermined positions as shown in FIG. 2. Further, the casting sleeve 22 is formed with an oil feed inlet 30*a* for lubrication of the slidable plunger tip 23**.

An annular groove **23*b* provided on the outer periphery of the plunger tip 23 and an annular groove 26*a* provided in the adapter 26 communicate with each other through an air passage 23*c*. An annular groove 27*a* provided in the adapter 27 communicates with the annular groove 26*a* through an air passage 27*b* provided with a filter 31 of metal mesh. An air passage 32 formed between the air passage hole 24*c* of the plunger rod 24 and the tube 28*b* is in communication with the annular groove 27*a* through an air passage 33. To an evacuation hole 34 opened to the lower portion of the air passage 32, a piping 35 of an air pressure circuit (which will be described later) shown in FIG. 1 is connected. On the other hand, the tube 29*b* for water cooling has its lower opening portion being in communication with a cooling water inlet 35 through a cooling water passage 29*d* and an annular groove 29*c* and its upper opening portion being in communication with a cooling water outlet 39 through the cavity 23*a*, a cooling water passage 36 extending downwards around the tube 29*b*, a water passage 37 and an annular groove 38. The cooling water inlet 35 is connected to a pump etc. by means of a flexible hose etc. The cooling water fed to the cooling water inlet 35 by the actuation of the pump rises within the tube 29*b* and fills the cavity 23*a* to cool the plunger tip 23. Then, the cooling water flows down through the cooling water passage 36 and is drained from the cooling water outlet 39**.

Figure 6:
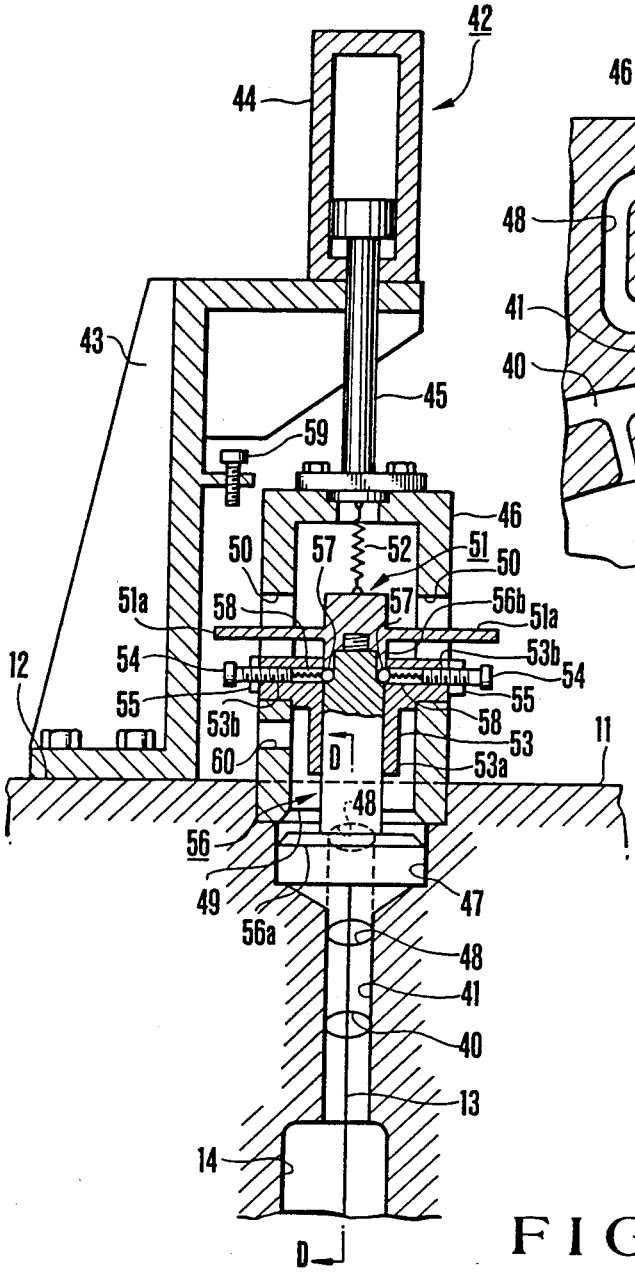
FIG. 6 is longitudinal section illustrating a venting device employed in the invention.
Figure 7:
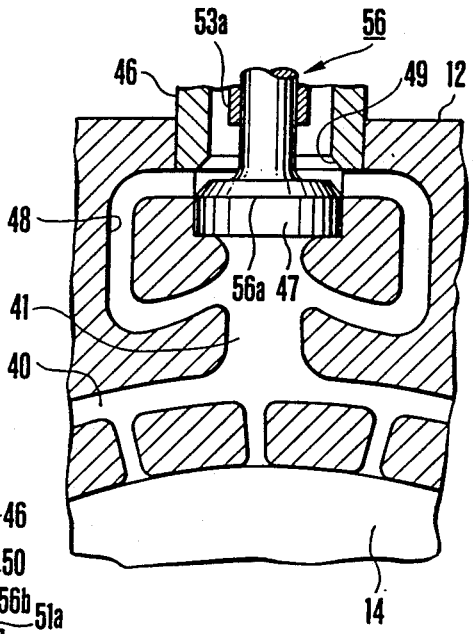
FIG. 7 is a longitudinal sectional view taken along the line D—D of FIG. 6.

A die inner gas venting device will be now described. As best shown in FIGS. 6 and 7, the cavity 14 communicates with a gas vent path 40 and a gas vent groove 41 which are defined symmetrically with the dividing surface 13 by the joined metal molds 11 and 12. A die inner gas venting device, generally denoted by reference numeral 42, is located directly above the gas vent groove 41 and is fixed e.g. on the movable metal mold 12. Namely, on the upper end of a bracket 43 fixed on the movable metal mold 12, a cylinder 44 is secured. Fixed to a lower end flange portion serving as the operating end of a piston rod 45 operable to advance or withdraw under the application of a fluid pressure to the cylinder 44, is a cylindrical spool 46 whose lower end portion is removably mounted in a circular hole formed in the upper surface of both the metal molds 11 and 12. At the time of clamping or opening the die, the spool 46 can be inserted into or separated from the circular hole by means of the piston rod 45 actuated by the cylinder 44. Below the spool 46 inserted into the metal molds 11 and 12, there are provided a valve chamber 47, and bypasses 48 laterally detouring to allow both the valve chamber 47 and the gas vent path 41 to communicate with each other. Formed in the lower end surface of the spool 46 is a valve seat 49 facing the valve chamber 47. Into a pair of elongated holes 50 provided in the outer peripheral wall of the spool 46, oppositely extending lever arms 51*a* of a return lever 51 are slidably fitted. Between the return lever 51 and the flange portion of the piston rod 45, members e.g. a tension spring 52 for upwardly biasing the return lever 51, a cylinder, a solenoid device, and a gravity device etc. are suspended. Below the return lever 51, valve guide 53 having a cylindrical portion 53*a* and a pair of -- arms with threaded hole 53*b* is fixed to the spool 46 with the arms 53*b* mounted in the elongated hole 50. A valve rod 56 of which upper threaded end is meshed with a threaded bore of the return lever 51 is slidably mounted in the cylindrical portion 53*a*. The valve rod 56 is provided at its lower end with a valve member 56*a* which rests on the valve seat 49 when the valve rod 56 is raised. The valve member 56*a* which has been opened under the application of a pressure of gas in the cavity 14 rest on the valve seat 49 by receiving an inertial force of the hot molten metal dashing from the cavity 14 so as to close a path between an internal chamber of the spool 46 and a portion including the gas vent groove 41 and the bypass 48. Balls 57 biased by compression coil springs 59 to engage a groove 46*b* of the valve rod 56, bolts 54 and nuts 55 constitute an engagement mechanism. The tention spring 52 will prevent the valve member 56*a* which has been closed once by a pressure of hot molten metal from re-opening unless an external force is applied. The valve member 56*a* is opened by pushing downwardly the lever arms 51*a* of the return lever 51. A stopper 59 fixed to the bracket 43 for limiting the upward movement of the lever arm 51*a* along with the spool 46 caused by the activation of the cylinder 44. At the lower portion of the spool 46, an exhaust hole 60 is opened. The exhaust hole 60 is connected to a piping 61 of an air pressure circuit (which will be described later) shown in FIG. 1.

The air pressure circuits for use with the plunger 20 and the venting device 42 will be described with reference to FIG. 1. A piping 63 connected to a vacuum pump 62 branches to a piping 64 and 65. On the pipings 63 and 64, a vacuum tank 66 and an auxiliary vacuum tank 67 are provided, respectively. The piping 63 is connectable to he piping 61 through a filter 68. Likewise, the piping 64 is connectable to the piping 35 through a filter 69. On the piping 64, an electromagnetic valve 70 is disposed. Likewise, on the piping 65, an electromagnetic valve 71 is disposed. When a solenoid of the electromagnetic valve 70 is energized from the condition shown, air within the plunger 20 is evacuated. Similarly, when a solenoid of the electromagnetic valve 71 is energized from the condition shown, air within the cavity 14 is evacuated through the venting device 42. In this example, by a command from a timing regulating device (not shown), the setting is made such that the evacuation through the venting device 42 is delayed as compared to the evacuation from the plunger 20 by, for example, about 0.2 to 1 sec., preferably 0.3 to 0.5 sec. The setting is further made such that the degree of vacuum for the plunger 20 is e.g. about 200 to 300 Torr and the degree of vacuum for the venting device 42 is e.g. about 150 to 250 Torr. Such a difference in degree of vacuum can be obtained by the provision of the auxiliary vacuum tank 67. The auxiliary vacuum tank 67 is preferably provided as near the plunger 20 as possible by taking into account a resistance against fluid flow of a relatively thin piping portion or passage at the time of vacuum evacuation. In addition, it is preferably that the piping 35 provided with a flexible hose 35*a* has a length as short as possible and a relatively large diameter of e.g. 1 inch.

To the other port of the electromagnetic valve 70, a piping 74 provided with an electromagnetic valve 72 is connected. Likewise, to the other port of the electromagnetic valve 71, a piping 75 provided with an electromagnetic valve 73 is connected. The pipings 74 and 75 are combined into a piping 77 provided with a variable throttle valve 76. The piping 77 is connected to e.g. an air compressor 78 provided in a factory. By closing the electromagnetic valves 70 and 71 and opening the electromagnetic valves 72 and 73, highly pressurized air is delivered to the plunger 20 and the venting device 42 and sprayed for cleaning the interior.

Figure 8:
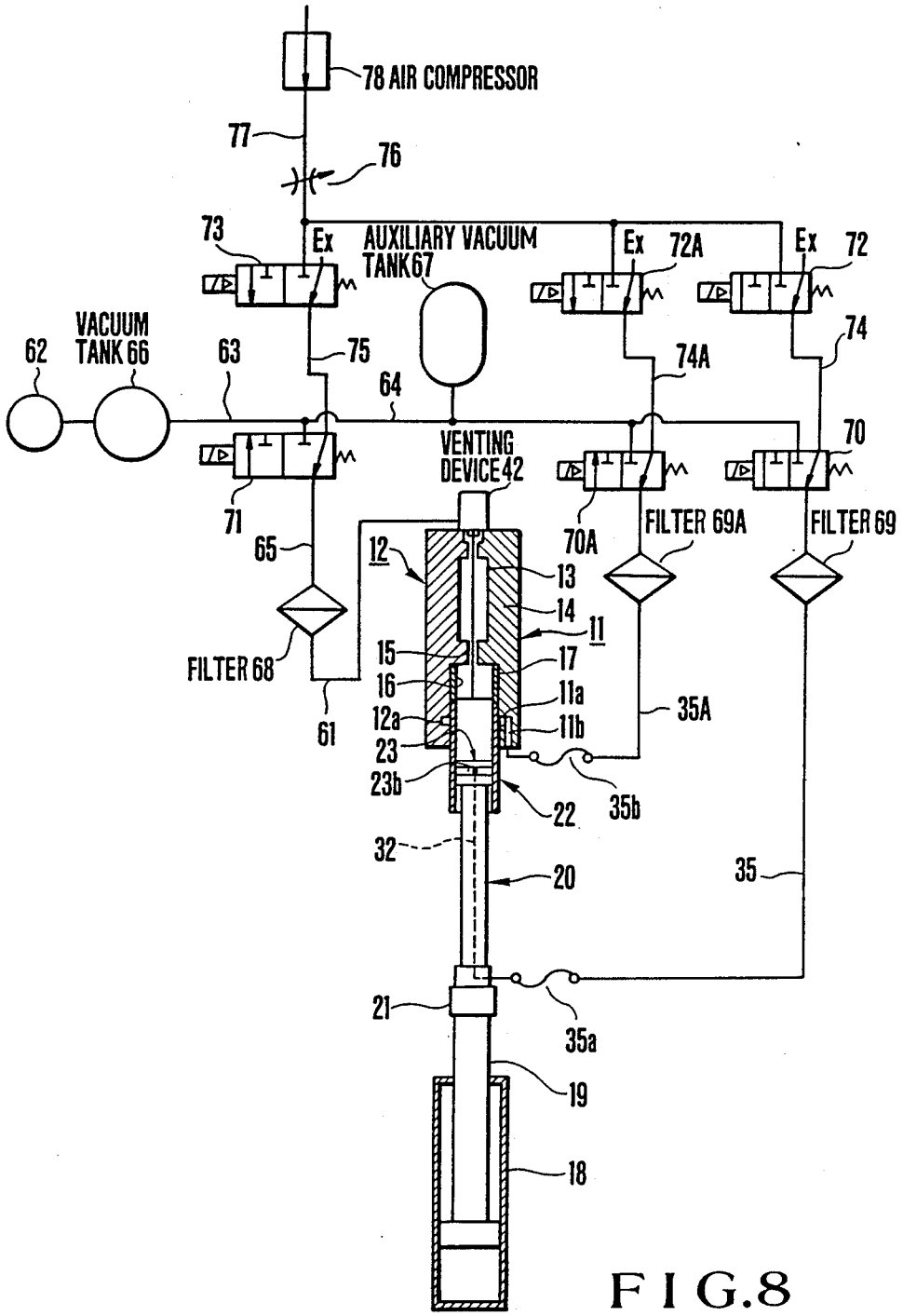
FIG. 8 is a diagrammatical view illustrating a second embodiment of a casting apparatus employed in the present invention and an air pressure pipe arrangement associated therewith.
Figure 9:
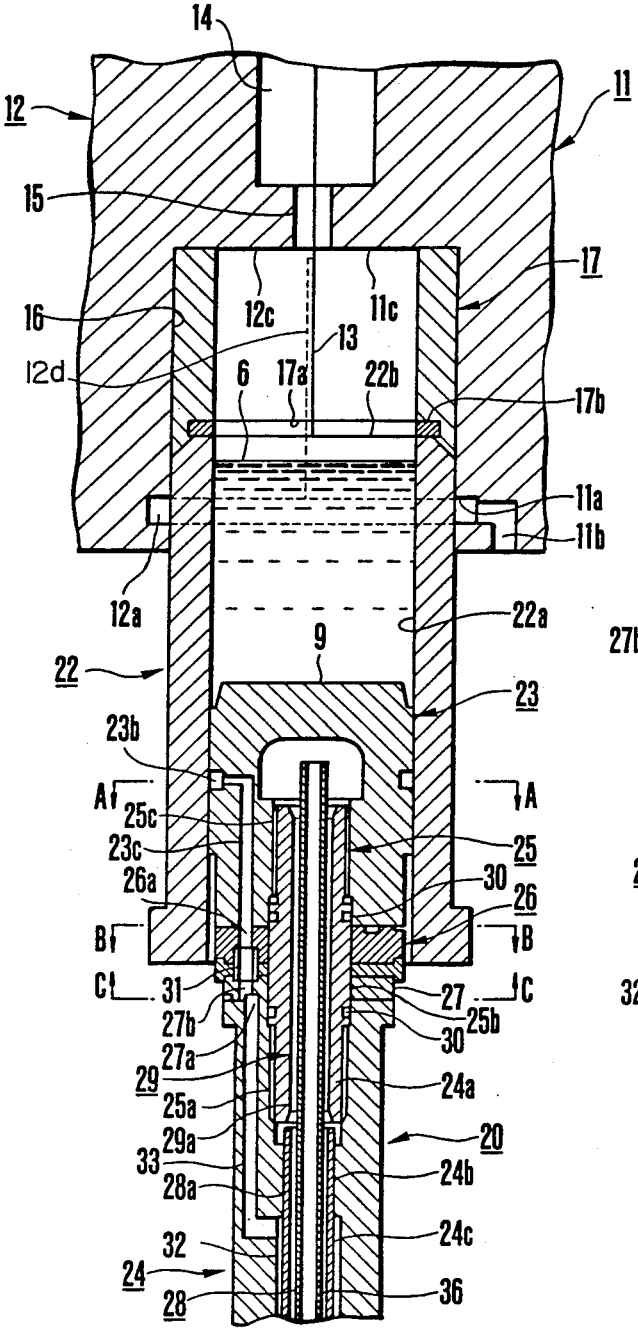
FIG. 9 is an enlarged longitudinal sectional view illustrating an injection sleeve and a plunger provided in the casting apparatus shown in FIG. 8.
Figure 10:
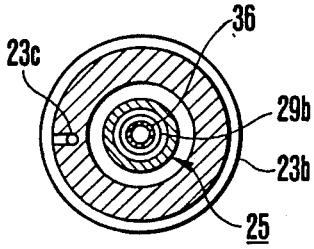
FIG. 10 is a cross sectional view taken along the line A—A of FIG. 9.
Figure 11:
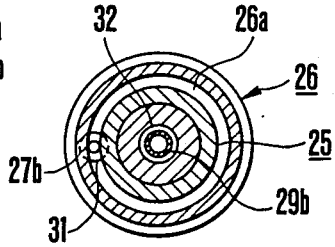
FIG. 11 is a cross sectional view taken along the line B—B of FIG. 9.
Figure 12:
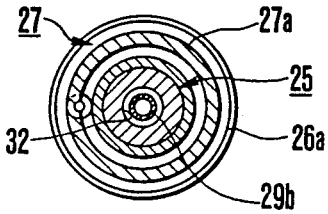
FIG. 12 is a cross sectional view taken along the line C—C of FIG. 9.
Figure 13:
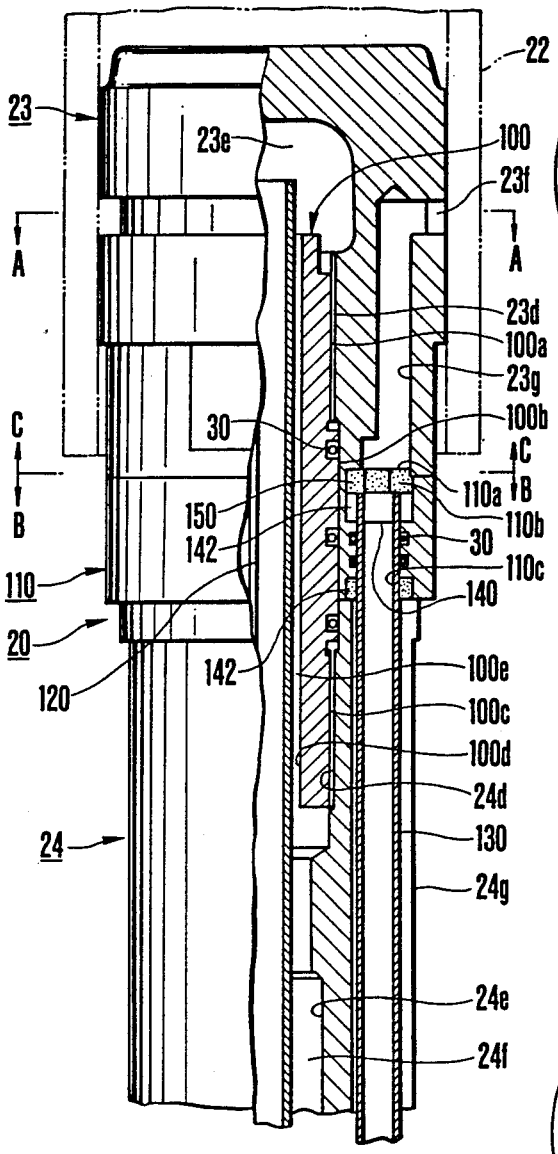
FIG. 13 is front view, partly sectioned, illustrating a plunger device in a third embodiment of a casting apparatus according to the invention.
Figure 14:
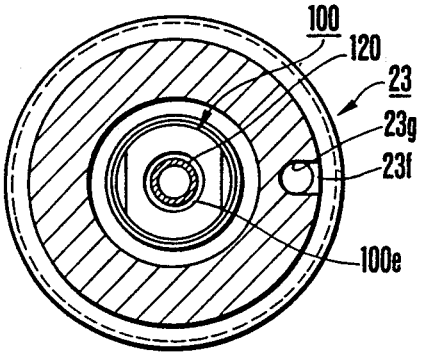
FIG. 14 is a cross sectional view taken along the line A—A of FIG. 13.
Figure 15:
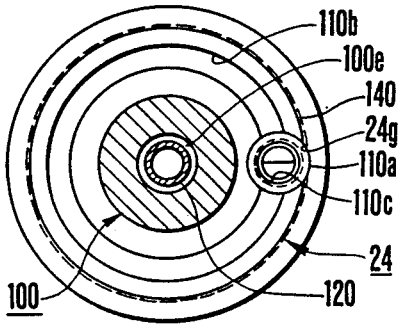
FIG. 15 is a cross sectional view taken along the line B—B of FIG. 13.
Figure 16:
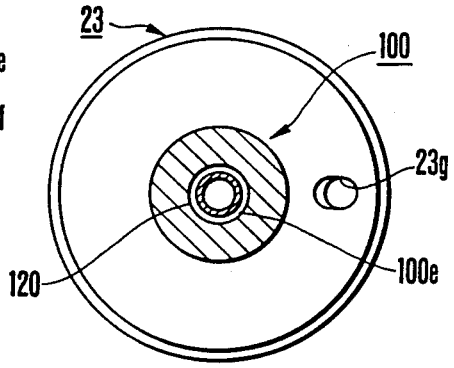
FIG. 16 is a cross sectional view taken along the line C—C of FIG. 13.

A casting method with the die casting machine thus configured will be described. First is to move the movable metal mold 12 to the position shown to effect mold clamping. Next is to activate the cylinder 44 of the venting device 42 to insert the spool 46 into the spool hole formed in the metal molds 11 and 12 in a manner shown. At this time, the piston rod 19 of the injection cylinder 18 and the injection sleeve 22 are located at a lower position. Accordingly, the injection cylinder 18 is tilted, hot molten metal is poured into the injection sleeve 22 within which the plunger 20 is located at a lower position and the injection cylinder 18 is again set up vertically. Thereafter, the injection sleeve is raised to engage stationary sleeve 17 in a manner shown. After vacuum evacuation, when oil feed to the injection cylinder 18 is carried out to elevate the piston rod 19, the plunger 20 rises to initiate the injection of the hot molten metal denoted by reference numeral 6 in FIG. 2. At this time, since the cooling water has been supplied through the cooling water inlet 35 to the plunger 20, rises within the tube 29*b*, fills the cavity 23*a* and then flows downwardly within the cooling water passage 36 the plunger tip 23 and the plunger rod 24 are cooled. Further, the injection sleeve 22 is cooled from the outside by a cooling device (not shown). Accordingly, the molten metal is partly solidified and a solidification layer denoted by reference numeral 9 in FIGS. 2 and 8 is created on the upper end surface of the plunger tip 23 and the inner wall surface of the injection sleeve 22 contiguous thereto. Since the interior of each of the vacuum tank 66 and the auxiliary tank 67 has been evacuated by the vacuum pump 62, when the electromagnetic valve 70 is first opened prior to the initiation or in the course of the injection, a negative pressure acts on the evacuation hole 34 of the plunger rod 24, with the result that air within the annular groove 23*b* of the plunger tip 23 is evacuated via the air passage 23*c*, the annular groove 26*a*, the filter 31, the air passage 27*b*, the annular groove 27*a*, the air passage 33, and the air passage 32. Further, when the electromagnetic value 71 is opened at a delayed timing of e.g. 0.3 to 0.5 sec with respect to the above-mentioned evacuation, gas within the cavity 14 is evacuated via the gas vent path 40, the gas vent groove 41, the bypass 48 and the exhaust hole 60 because the valve member 56*a* of the venting device 42 is opened at this time. In a manner stated above, both the plunger 20 and the venting device 42 is evacuated and eventually, the degree of vacuum within the cavity 14 and the degree of vacuum in a gap between the injection sleeve 22 and the plunger tip 23 become equal to each other. Especially, by evacuating of the plunger 20 at a timing slightly earlier than that for the venting device 42 and by making larger the degree of vacuum for the plunger 20 than that for the venting device 42, the solidification layer 9 comes in close contact with the end surface of the plunger tip 23 and the annular recessed portion therearound. As a result, the solidification layer 9 is reinforced and is cooled to 300° to 400° C. according as the cooling of the plunger tip 23 progresses, resulting in a thick solidification layer. Thus, this prevents air from entering through the gap between the injection sleeve 22 and the plunger tip 23. Further, there is no possibility that hot molten metal is sputtered into the cavity 14 prior to the injection of the hot molten metal.

After the interior of the cavity 14 etc. is thus evacuated to vacuum, a injection operation is conducted to advance the plunger 23 while carrying out venting. As a result, hot molten metal 6 within the injection sleeve 22 is injected into the cavity 14 via the stationary sleeve 17 and the constricted portion 15. When the cavity 14 is filled with the hot molten metal 6, the hot molten metal 6 rises within the gas vent groove 41. As a result, the hot molten metal 6 comes in contact with the lower surface of the valve member **56*a* along with the gas. An impact applied to the valve member 56*a* at this time is larger than an impact rendered by gas because of the large inertia of the hot molten metal resulting from the fact that the mass of the hot molten metal 6 is extremely large as compared to that of the gas. As a result, while compressing the compression spring 58 through the balls 57, the valve member 56*a* rises to close the valve seat 49. Accordingly, even in the case where the hot molten metal 6 is prevented from escaping through the valve seat 49 and mixed with gas within the gas vent path 40 and gas vent groove 41 so as to be turned into splash which discontinuously bombards the valve member 56*a***, *the valve member 56a* is maintained at an upper position thereof because the valve member **56*a* pushed up once by the hot molten metal is tensioned upwardly by the tension spring 52, thus making it possible that the evacuation passage is securely closed by the valve member 56*a***.

Final step is to apply a pressure to the valve member **56*a* and cool it for a predetermined time with the valve member 56*a* being closed, to open the movable metal mold 12, and to elevate the spool 46 by means of the cylinder 44 of the venting device 42 in order for the spool 46 to disengage from the movable metal mold 12, thus permitting removal of the product from the cavity 14**.

The upward movement of the spool 46 precedes the upward movement of the valve rod 56 because of separation resistance between the valve member **56*a* and the solidified metal. As a result, the balls 57 which have been out of engagement with the groove 56*b* of the valve rod 56 again engages the groove 56, thus completing preparation for the next casting work. At the upper limit of the upward movement of the spool 46, the lever arms 51*a* come in contact with the stopper 59 to push the valve rod 56 downwardly. Accordingly, the valve member 56*a*** is securely opened, thus arranging for the next casting work.

In the above-mentioned embodiment, it has been illustrated that the present invention is implemented as a die casting machine of the vertical die casting type. By setting a timing of the vacuum evacuation so that it is initiated immediately after the hot molten metal pouring inlet of the injection sleeve is clogged after the injection is initiated, the present invention can be implemented as a die casting machine of the lateral casting type in the same manner.

As seen from the foregoing description, the casting apparatus of the first embodiment is configured to provide, in the outer peripheral surface of the plunger tip, an annular groove communicating with the metal mold cavity through a gap, and to provide a venting device for the metal mold cavity, whereby after evacuation of air within the annular groove toward the outside is initiated prior to initiation or in the course of advancing of the plunger tip, air within the metal mold cavity is evacuated toward the outside via the venting device at a slightly delayed timing. As a result, the solidification layer of hot molten metal formed on the end surface of the plunger tip is closely in contact therewith, and further becomes thick and reinforced by cooling. Accordingly, the solidification layer prevents air which otherwise enters into the metal mold cavity through a gap between the plunger tip and the injection sleeve. This eliminates the possibility that hot molten metal is sputtered into the metal mold cavity and impurity is mixed into the hot molten metal, thus making it possible to desirably effect injection and to remarkably improve the quality of casting products.

A second preferred embodiment of the invention will now be described with reference to FIGS. 8 to 12. The elementary configuration of this embodiment is similar to the above-mentioned first embodiment. Parts identical to those in the first embodiment are designated by the same reference numerals, respectively, and therefore their explanation will be omitted. As will be seen from the following description, according to this embodiment, the adverse flow into the die cavity can be prevented more efficiently as compared to the first embodiment.

The plunger device of this embodiment differs from that of the above-mentioned first embodiment as described blow.

Namely, an injection sleeve 22 into which a plunger tip 23 of a plunger 20 is slidably inserted is also removably inserted into an injection bore 16 of the metal molds 11 and 12. The injection sleeve 22 is chamfered at its upper end. Between an engaging upper end surface **22*b* and a lower end surface of a stationary sleeve 17, a packing 17*b* serving as a sealing member is interposed which is composed of circular halves of a heat resisting material e.g. copper or asbestos and which is fixed to the stationary sleeve 17. Between the injection bore 16 and the injection sleeve 22 inserted thereto, circular halves of grooves 11*a* and 12*a* and a longitudinal groove 12*d* are provided in the metal molds 11 and 12, respectively. The longitudinal groove 12*d* is formed along the dividing surface 13 and communicated with the grooves 11*a* and 12*a*. The circular half of groove 11*a* in the stationary metal mold 11 communicates with an air passage 11*b*** which is opened to the outside.

To this opening, a piping 35A shown in FIG. 8 is connected.

The air pressure circuit of this embodiment differs from that of the above-mentioned first embodiment as described below.

Namely, the piping 35A connected to the air passage **11*b* formed in the above-mentioned stationary metal mold 11 is provided with a filter 69A, a flexible portion 35*b* and an electromagnetic valve 70A. This piping 35A is connected with an upstream of the electromagnetic valve 70 (as viewed from an auxiliary vacuum tank 67) of a piping 35 extending from the auxiliary vacuum tank 67 to the plunger 20. Further, connected to the other port of the electromagnetic valve 70A is a piping 74A** provided with an electromagnetic valve 72A. Pipings 72, 72A and 75 extending via electromagnetic valves 72, 72A and 73 join at a piping 77 which is connected via a variable throttle valve 76 to e.g. air compressor 78 provided in a factory. By closing the electromagnetic valves 70, 71 and 70A and opening the electromagnetic valves 72, 73 and 72A, highly pressurized air is fed to the plunger 20, the injection sleeve 22 and a venting device 42 of the same type as that of the previous embodiment and sprayed for cleaning the interior.

In operation, when the electromagnetic valve 70A is opened concurrently with the opening of the electromagnetic valve 70, a negative pressure acts on the air passage 11*b* communicating with the circular halves of grooves 11*a* and 12*a*, with the result that air within the grooves 11*a* and 12*a*, is evacuated via the air passage 11*b*. As in the first embodiment, the electromagnetic valve 71 is opened at a timing which is delayed 0.2 to 1 second, preferably, 0.3 to 0.5 seconds. Because of the provision of the additional evacuation system of 70A, 69A, 35A and 35*b*, the adverse air flow into the die cavity can be prevented more efficiently.

According as the plunger tip 23 advances, the solidification layer 9 is pushed thereby so that it rises until the upper end of the solidification layer 9 comes in contact with planes 11*c* and 12*c* in front of the constricted portion 15. However, because air is being evacuated through grooves 11*a* and 12*a* and because the chamfered portion and the packing 17*b* are provided at the contact portion between both the sleeves 17 and 22, air is not admitted and the cylindrical portion of the solidification layer 9 rises together with the plunger tip 23 while making close contact to the inner peripheral surface of the injection sleeve 22, until the upper end thereof comes in contact with the planes 11*c* and 12*c* in front of the restricted portion 15. When the plunger tip 23 further rises, the solidification layer 9 is crushed down between the end surface of the plunger tip 23 and the planes 11*c* and 12*c* of the metal molds 11 and 12. Although under this condition the interior of the cavity 14 is evacuated to vacuum from above, there is no possibility that air is admitted from the injection sleeve and hence the molten metal will not be mixed and the flow of molten metal will not be disturbed. After filling the cavity 14 the hot molten metal 6 rises within the gas vent groove 41, and comes in contact with the lower surface of the valve member 56*a* along with the gas. Thus, the valve seat 49 is closed by the valve member 56*a* in a manner similar to the first-mentioned embodiment.

In connection with venting effect, ordinary aluminum products contain gas of 40 to 60 cc/100 g aluminum. By employing the venting device 42, the amount of gas is reduced to 5 to 10 cc/100 g aluminum, thus providing excellent products having a pressure-proof property of 100 to 105 $Kg/Cm^2$. In general, when the gas content is less than 5 cc/100 g aluminum, heat treatment is possible. Especially, when the gas content is less than 1 cc/100 g aluminum, welding is possible. By evacuating both the cavity 14 and injection sleeve, injection products to which both the heat treatment and welding can be applied can be obtained. This is possible by using return materials as well as new materials.

As seen from the foregoing description, a vertical type injection device for a die casting machine according to the second embodiment comprises a vacuum evacuation device for evacuating gas within the metal mold cavity under a condition that the hot molten metal is supplied to the injection sleeve, and a cavity formed in the metal molds to open to the injection hole portion and connected to the vacuum evacuation device thereby evacuating gas prevailing within the metal mold cavity and between the injection sleeve and the die. Thus, venting can be hastened, resulting in high quality products. Even when a solidification layer of the hot molten metal produced on the end surface in contact with the hot molten metal of the plunger tip is pushed up in accordance with the elevation of the plunger, air within the injection bore is evacuated to the outside, with the result that air will not admitted to a gap between the injection sleeve and the die. Accordingly, there are not produced gas pockets or pinholes in the die casting product, providing excellent casting surface and greatly improved quality of the casting products.

A third preferred embodiment of a vertical injection apparatus for a die casting machine according to the present invention will be described with reference to FIGS. 13 to 17.

The vertical injection apparatus of this embodiment comprises a cylindrical injection sleeve 22 adapted to advance and withdraw relative to a stationary sleeve on the side of a die (not shown) wherein the injection sleeve 22 is filled with hot molten metal by a hot molten metal feed device (not shown). A plunger tip 23 serving as the head of the plunger 20 is slidably fitted into the injection sleeve 22. The plunger tip 23 is provided with a threaded bore 23*d* opening to one end of the plunger tip 23 and a cavity 23*e* communicating therewith. A tip joint 100 has the entire length which is substantially equally divided into three to provide a first threaded portion 100*a*, a cylindrical portion 100*b* and a second thread portion 100*c*. The tip joint 100 is further provided with an internal bore 100*d* extending through the opposite ends thereof. The first threaded portion 100*a* is removably meshed with the threaded bore 23*d* of the plunger tip 23. An adapter contiguous to the plunger tip 23 and having the same diameter as a radially reduced portion of the plunger tip 23 is loosely fitted on the cylindrical portion 100*b* of the tip joining 100.

A threaded bore 24*d*, opening to the upper end, of a relatively long plunger rod 24 is removably meshed with the lower threaded portion 100*c* of the tip joint 100. The plunger rod 24 is also with a bore 24*e* having a closed lower end (not shown). Namely, the plunger tip 23 and the plunger rod 24 between which the adapter 110 is interposed are detachably put together by the tip joint 100. A cooling water tube 120 is provided so that it penetrates through the internal bore 100*d* of the tip joint 100 and the internal bore 24*e* of the plunger rod 24. One end of the cooling water tube 120 is fixed to the plunger rod 24 and the other end thereof faces the cavity 23*e*. Further, between the cooling water tube 120 and the internal bores 100*d* and 24*e*, cooling water passages 100*e* and 24*f* are formed. The one end of the cooling tube 120 and the one end of the cooling passage 100*e* are connected to a cooling water source and a drain tube through cooling water inlet and outlet (not shown) formed in the plunger rod 24, respectively. Cooling water from the cooling water source fills the cavity 23*e* through the cooling water tube 120 and thereafter is drained through the cooling water passages 100*e* and 24*f*, thus cooling the plunger tip 23.

The adapter 110 is formed, at it end surface opposing the plunger tip 23, with a recessed bore 110*a* and an annular groove 110*b*. The recessed bore 110*a* and the annular groove 110b communicate with a gap between the plunger tip 23 and the injection sleeve 22 by way of an annular groove 23f formed in the outer peripheral surface of the plunger tip 23 and an axial air passage 23g in communication with a portion of the annular groove 23f. On the other hand, in the outer peripheral portion of the plunger rod 24, there is formed an axial notch 24g having a U-shaped cross section which opens to the peripheral surface. The notch 24g extends over substantially the entire length of the plunger rod 24. The adapter 110 is provided with a hole 110c allowing the notch 24g to communicate with the recessed bore 110a. The injection plunger device of this embodiment further comprises a tube 130 for vacuum evacuation formed of teflon (T.N.) tube or copper tube etc., with one end thereof being removably mounted to an end portion (not shown) of the plunger rod 24. The evacuation tube 130 is connected to vacuum generating device (not shown) through a port provided for the plunger rod 24. The evacuation tube 130 is inserted into the notch 24g of the plunger rod 24 through the opening exposed to the peripheral surface thereof. A portion of the evacuation tube 130 projecting beyond the plunger 24 is detachably inserted into the hole 110c of the adapter 110 so that its upper end faces the recessed bore 110a. With the configuration stated above, when the vacuum generating device is actuated, air prevailing within a gap between the injection sleeve 22 and the plunger tip 23 and within the injection sleeve 22 is evacuated toward the annular groove 110b via the annular groove 23f and the air passage 23g, and eventually to the outside through the evacuation tube 130. The evacuation tube 130 is suspended by hooking a wire 140 piercing therethrough on a shoulder defined by the recessed bore 110a and the hole 110c. The both ends of the hole 110c is sealed with a liquid packing 142 handenable when dried. Within the recessed bore 110a, a filter 150 is filled. In this embodiment, there are provided O-rings 30 serving as sealing agent in a manner similar to the above-mentioned embodiments.

The operation of the injection plunger device thus configured will be described. First is to supply hot molten metal into the injection sleeve 22 and then to adapt the injection sleeve 22 into the stationary sleeve on the side of the die. Next is to advance the plunger 20 by feeding oil into the injection cylinder to inject the hot molten metal within the injection sleeve 22 into the cavity of the die. When gas within the cavity of the die is evacuated simultaneously with the initiation of the injection through the venting device and the vacuum generating device connected to the evacuation tube 130 is actuated, air within the injection sleeve 22 is evacuated to vacuum via the annular groove 23f, the air passage 23g, the recessed bore 110a the annular groove 110b, and the evacuation tube 130. Accordingly, this prevents air from passing through a gap between the injection sleeve 22 and the plunger tip 23, and flowing into the injection sleeve 22 with the result that penetration of moisture or mold release etc. is avoided.

In the event that hot molten metal is sucked under the vacuum evacuation and the tube 130 is clogged with the hot molten metal, a procedure is carried out to pull the plunger 20 out of the injection sleeve 22, release meshing engagement of the plunger tip 23, and thereafter release fixing of the other end (not shown) of the evacuation tube 130. Thus, the adapter 110 can be easily detached from the chip joint 100 with the evacuation tube 130 being retained in the hole 110c of the adapter 110. Next is to pull the evacuation tube 130 toward the recessed bore 110a so as to remove the tube 130 from the dismounted adapter 110, and to insert a new evacuation tube into the recessed bore 110a so as to assemble parts in the order opposite to the precedence, thus completing the exchange work of the evacuation tube 130. In the third embodiment, it has been described that the air passage 23g of the plunger tip 23 and the recessed bore 110a are in phase with each other with respect to the circumferential direction. Although there is a possibility that such an in-phase relationship changes depending upon the clamping condition of the plunger tip 23 for fixing the adapter 110, there is no inconvenience in the communication of the air passage.

Figure 17:
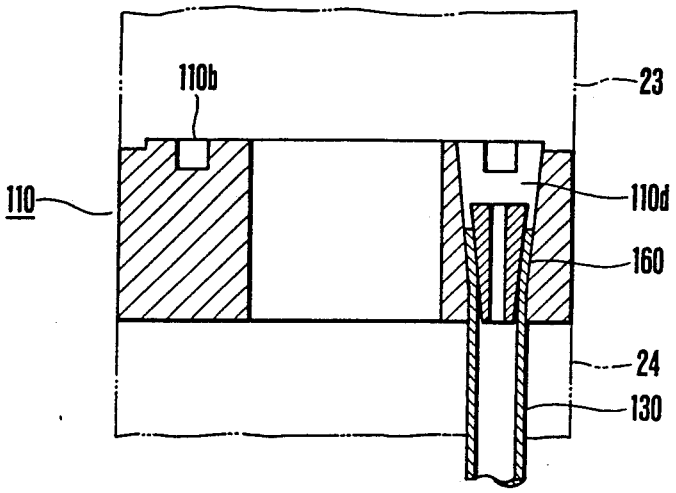
FIG. 17 is a sectional view illustrating a modification of a holding structure of a vacuum evacuation tube implemented by using an adapter.
Figure 18:
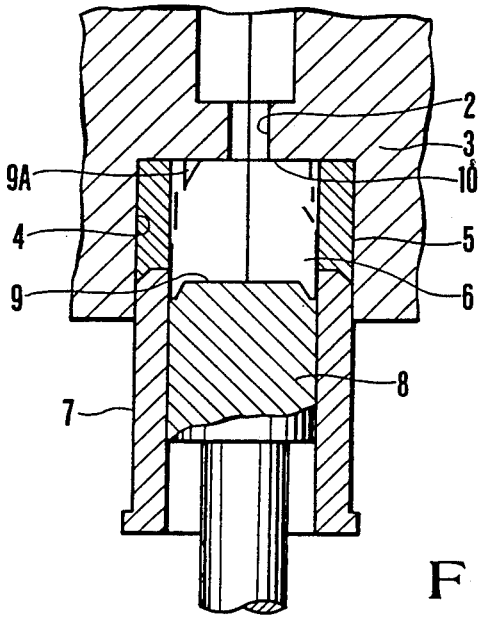
FIG.18 (PRIOR ART)
FIG. 18 is a sectional view for explaining behavior of a solidification layer in a conventional apparatus.

FIG. 17 is a cross sectional view illustrating a portion of the evacuation tube retained by an adapter according to a modified embodiment. In this modified embodiment, the hole divided into the recessed bore 110a and the hole 110c in the above-mentioned third embodiment is replaced with a single tapered 110d. The evacuation tube 130 is inserted into a lower straight hole portion of the tapered hole 110d until it reaches a central portion of the tapered hole 110d. Then, a wedge-like bored stopper 160 is knocked down into the evacuation tube 130 from above to deform the evacuation tube 130. The evacuation tube 130 thus deformed will not slip down toward the plunger rod 24. The structure for retaining the evacuation tube 130 is not limited to the wire 140 or tapered stopper 160 as employed in the above-mentioned embodiments. In the present invention, there may be employed other means for preventing the evacuation tube 130 from slipping down toward the plunger rod 24, e.g., a band wound about the upper end of the evacuation tube 130 and resting the shoulder mentioned previously.

As seen from the foregoing description, the injection device for a die casting machine according to the third embodiment comprises a cavity, formed in the upper end surface, opposing the plunger tip of the adapter interposed between the plunger tip and the plunger rod, for communicating with a gap between the plunger tip and the injection sleeve, an axially extending notch formed in the outer peripheral surface of the plunger rod, to open to the adapter and the outer periphery, and an evacuation tube held in the notch and having removably inserted into the bore connecting the notch to the cavity and the other end removably held for connection to the vacuum generating device, the upper end of the evacuation tube facing the cavity. Accordingly, it is needless to say that the injection plunger device for die casting machine according to the third embodiment can provide the vacuum evacuating effect inherent to the plunger device to prevent air from flowing into the plunger device via the gap between the injection sleeve and the plunger tip. In addition, even in the event that the air passage for vacuum evacuation is clogged, the plunger device of this embodiment can readily repair the clogged condition by simply exchanging the evacuation tube without resort to cutting or exchange of the plunger rod as required in the prior art. Because the exchange of the evacuation tube is easily carried out, it is possible to considerably save labor and expense.

What is claimed is:

1. A vertical injection apparatus for a die casting machine comprising:

a die having a die cavity;

an injection sleeve slidably fitted in an injection bore formed in the lower end portion of said die;

a stationary sleeve fixedly mounted in the injection bore and engagable with said injection sleeve; and plunger means, slidable in said injection sleeve, for injecting a molten material poured into said injection sleeve, a first portion of said injection sleeve, which comes into contact with said molten material poured into said injection sleeve, permitting the intrusion of ambient air;

evacuation means for evacuating ambient air from said die and said injection sleeve prior to the initiation of said injection of said molten material, said evacuation means including a timing means for controlling said evacuation means such that said ambient air is evacuated from said first portion of said injection sleeve a predetermined amount of time prior to the evacuation of said ambient air from said die.

2. A vertical injection apparatus according to claim 1 wherein said evacuation of said evacuating means precedes more than 0.2 second from the evacuation of said die cavity.

3. A vertical injection apparatus according to claim 1, wherein said portion includes a gap between said injection sleeve and plunger means so that air prevailing through said gap is evacuated.

4. A vertical injection apparatus according to claim 3, wherein said plunger means has a plunger tip formed, in its outer peripheral surface, with an annular groove whereby the evacuation of said portion is effected through said annular groove.

5. A vertical injection apparatus according to claim 3, wherein said portion further includes a dividing surface at which metal molds of said die is joined and air prevailing from said dividing surface and between said die and said injection sleeve are evacuated by said evacuating means.

6. A vertical injection apparatus according to claim 5, wherein a sealing member is provided between the upper end surface of said injection sleeve and the lower end surface of said stationary sleeve.

7. A vertical injection apparatus according to claim 6, wherein said sealing member is fixed to said stationary sleeve.

8. A vertical injection apparatus according to claim 1, wherein said plunger means comprises a plunger tip and a plunger rod, an adapter is detachably mounted between said plunger tip and said plunger rod, said adapter having a cavity formed in its end portion opposing said plunger tip so as to be in communication with a gap between said plunger tip and injection sleeve and contiguous to a hole formed in said adapter, a notch is formed in said plunger rod, said notch opening to the outer peripheral surface of said plunger rod, and a vacuum evacuation tube is fitted in said notch, having one end connected to a vacuum evacuating device and the other end detachably inserted in said hole in said adapter.

9. A vertical injection apparatus according to claim 1, wherein degree of vacuum for evacuation of said portion is larger than for evacuation of said die cavity.

* * * * *

UNITED STATES PATENT AND TRADEMARK OFFICE

CERTIFICATE OF CORRECTION

PATENT NO. : 4,871,010

DATED : 10/03/89

INVENTOR(S) : Dannoura

It is certified that error in the above-identified patent and that said Letters Patent is hereby corrected as shown below:

| | |
|---|---|
| col. 01, line 43 | delete "complete" insert --completion-- |
| col. 07, line 08 | before "arms" delete "--" |
| col. 07, line 43 | delete "he" insert --the-- |
| col. 08, line 37 | delete "." |
| col. 08, line 38 | delete "Further" insert --and, further,-- |

col. 8, line 47 before "opened" delete "first" insert --at first-- after "opened".

Signed and Sealed this

Fourth Day of December, 1990

*Attest:*

HARRY F. MANBECK, JR.

*Attesting Officer*

*Commissioner of Patents and Trademarks*